US009291140B2

(12) United States Patent
Schueler et al.

(10) Patent No.: US 9,291,140 B2
(45) Date of Patent: Mar. 22, 2016

(54) METHOD AND DEVICE FOR ACTIVATING A STARTER, WHICH IS CONTROLLABLE BY A DRIVER UNIT, FOR AN INTERNAL COMBUSTION ENGINE OF A MOTOR VEHICLE

(75) Inventors: Harald Schueler, Backnang (DE); Markus Roessle, Ludwigsburg (DE); Giuseppe Bisceglie, Turin (IT)

(73) Assignee: ROBERT BOSCH GMBH, Stuttgart (DE)

( * ) Notice: Subject to any disclaimer, the term of this patent is extended or adjusted under 35 U.S.C. 154(b) by 292 days.

(21) Appl. No.: 13/989,198

(22) PCT Filed: Nov. 2, 2011

(86) PCT No.: PCT/EP2011/069258

§ 371 (c)(1),
(2), (4) Date: Sep. 5, 2013

(87) PCT Pub. No.: WO2012/069293

PCT Pub. Date: May 31, 2012

(65) Prior Publication Data

US 2013/0334827 A1 Dec. 19, 2013

(30) Foreign Application Priority Data

Nov. 23, 2010 (DE) ..... 10 2010 061 781

(51) Int. Cl.
*F02N 11/08* (2006.01)
*F02D 41/28* (2006.01)
*F02N 11/10* (2006.01)

(52) U.S. Cl.
CPC ..... *F02N 11/0803* (2013.01); *F02D 41/28* (2013.01); *F02N 11/087* (2013.01); *F02N 11/10* (2013.01); *F02N 11/0814* (2013.01)

(58) Field of Classification Search
CPC . F02N 11/087; F02N 11/0851; F02N 11/108; F02N 11/10; F02N 11/0814; F02N 11/0803; F02D 41/28
USPC ..... 123/179.3; 290/38 C
See application file for complete search history.

(56) References Cited

U.S. PATENT DOCUMENTS 5,402,758 A * 4/1995 Land et al. ..... 123/179.3
5,622,148 A * 4/1997 Xue et al. ..... 123/179.25
7,689,335 B2 * 3/2010 Kaita et al. ..... 701/36

(Continued)

FOREIGN PATENT DOCUMENTS

CN 1511229 7/2004
CN 1834672 9/2006

(Continued)

*Primary Examiner* — Hieu T Vo
*Assistant Examiner* — Arnold Castro
(74) *Attorney, Agent, or Firm* — Kenyon & Kenyon LLP

(57) ABSTRACT

A method and device for activating a starter, which is controllable by a driver unit, for an internal combustion engine of a motor vehicle. A method for activating a starter, which is controllable by a driver unit, for an internal combustion engine of a motor vehicle, the driver unit being controllable by a control unit with the aid of at least one activation line, a switch, which is controllable by the control unit, being situated between the driver unit and a supply unit coupled to a supply voltage, the starter being activated with the aid of the control unit and the switch in the case of failure of the at least one activation line and/or at least one part of the driver unit.

14 Claims, 4 Drawing Sheets

(56) References Cited

U.S. PATENT DOCUMENTS

| | | | | |
|---|---|---|---|---|
| 7,938,096 | B2 * | 5/2011 | Yamaguchi et al. | 123/197.4 |
| 2002/0014216 | A1 * | 2/2002 | Boegner et al. | 123/179.3 |
| 2006/0208568 | A1 | 9/2006 | Kaita et al. | |
| 2007/0246012 | A1 * | 10/2007 | Ando | 123/406.13 |
| 2008/0127927 | A1 * | 6/2008 | Hirning et al. | 123/179.3 |
| 2009/0020091 | A1 * | 1/2009 | Botzenhard et al. | 123/179.3 |
| 2012/0186551 | A1 * | 7/2012 | Rentschler et al. | 123/179.3 |
| 2012/0191329 | A1 * | 7/2012 | Roessle et al. | 701/113 |
| 2012/0271508 | A1 * | 10/2012 | Kanemoto et al. | 701/33.6 |
| 2013/0066541 | A1 * | 3/2013 | Schueler et al. | 701/113 |
| 2013/0175810 | A1 * | 7/2013 | Moriya et al. | 290/38 R |

FOREIGN PATENT DOCUMENTS

| | | |
|---|---|---|
| CN | 201334982 | 10/2009 |
| DE | 102 22 162 | 11/2003 |
| DE | 102 31 088 | 1/2004 |
| DE | 10 2008 043563 | 5/2010 |
| EP | 1 369 569 | 12/2003 |

* cited by examiner

METHOD AND DEVICE FOR ACTIVATING A STARTER, WHICH IS CONTROLLABLE BY A DRIVER UNIT, FOR AN INTERNAL COMBUSTION ENGINE OF A MOTOR VEHICLE

FIELD OF THE INVENTION

The technical field of the present invention relates to the activation of a starter, which is controllable by a driver unit, for an internal combustion engine of a motor vehicle.

BACKGROUND INFORMATION

To start an internal combustion engine or a combustion engine, a starter motor of the starter is conventionally used, the starter motor driving a starter pinion of the starter to mesh with a ring gear of the crankshaft when the internal combustion engine is at a standstill in order to crank the crankshaft via the pinion-ring gear mesh thus produced. Here, the starter cranks the combustion engine to a minimum rotational speed in such a way that the combustion process may take place automatically and a stable idle state of the combustion engine may be achieved. Compared to the use of conventional start systems without a start-stop functionality, the use of start-stop systems results in an increase in the start frequency.

The activation of the start-stop system conventionally takes place with the aid of a driver unit or a relay driver unit (RDU) which receives control signals from the control unit or the engine control unit and energizes the relay of the starter motor as a function of the received control signals. This energization, in turn, results in the starter pinion meshing with the motor ring gear. A conventional starter relay includes a pull-in winding and a hold-in winding. With the aid of the pull-in winding, a stronger current is provided to pull in the armature of the relay. With the aid of the hold-in winding, a weaker current is provided to hold the armature of the relay in a switched position.

Publication DE 102 22 162 A1 discusses a method and a device for activating starters in internal combustion engines. Here, a starter is described which includes a meshing solenoid. Furthermore, activation signals are generated for the starter and the meshing solenoid. After the transmission of a start intention to an input function block, its output signals are processed in a processing block. The latter includes a diagnostic function module, a safety function against an overload of the starter, and a sequence control. Activation signals, which are decoupled from one another, are generated with the aid of an output block which includes power semiconductor components which represent preselectably clocked output stages.

Publication DE 102 31 088 A1 furthermore refers to a switching device for the start system of a combustion engine of a motor vehicle. The switching device is suitable for switching on a starter motor which starts the starter motor upon request from a control unit. The switching device includes a transistor which is connected to a control unit as well as an arrangement for checking the functionality of the transistor.

Publication DE 10 2008 043 563 A1 discusses a starter control unit in which a redundant safety switch is implemented for turning off the start-stop function in the starter control unit.

SUMMARY OF THE INVENTION

The present invention is based on the finding that by situating a switch, which is controllable by the control unit, between the driver unit of the starter and a supply unit coupled to a supply voltage, the starter is controllable with the aid of the control unit and the switch even in the case of failure of the activation lines of the driver unit and/or in the case of failure of the driver unit.

The driver unit is, for example, a relay driver unit. The control unit is, for example, configured as an engine control unit of the motor vehicle. The at least one activation line may include two interfaces between the control unit and the driver unit, which is, for example, configured as a bidirectional bus, e.g., a LIN bus, and as a hardwired interface having a pulse width-modulated signal.

The switch is, for example, configured as a controllable hardware switch. The supply voltage is, for example, the battery voltage of the motor vehicle. Here, the supply unit is, for example, configured as a terminal, terminal 30, for example.

Thus, the switch is operable directly by the control unit, namely the engine control unit, and is situated on the line between the battery and the relay driver unit. To increase the safety, the switch may be used as an emergency stop for the relay driver unit. Furthermore, the switch may also be used as a circuit breaker of the relay driver unit in case of a polarity reversal of the battery. The protection against a potential destruction is thus increased.

By using the switch or the safety switch which is switchable directly by the control unit, a start is also possible, if both interfaces between the control unit and the relay driver unit fail at the same time or also if a part of the relay driver unit itself fails. Additionally, an uncontrolled activation of the starter relay or the starter is prevented by the use according to the present invention of the safety switch in the case of failure of the relay driver unit. The safety and the availability of the overall system are thus advantageously increased by the present invention.

Accordingly, a method for activating a starter, which is controllable by a driver unit, for an internal combustion engine of a motor vehicle is proposed, the driver unit being controllable by a control unit with the aid of at least one activation line, a switch, which is controllable by the control unit, being situated between the driver unit and a supply unit coupled to a supply voltage, and the starter being activated with the aid of the control unit and the switch in the case of failure of the at least one activation line and/or at least one part of the driver unit.

Furthermore, a device for activating a starter, which is controllable by a driver unit, for an internal combustion engine of a motor vehicle is proposed, the driver unit being controllable by a control unit with the aid of at least one activation line. The device has a switch which is controllable by the control unit and which is situated between the driver unit and a supply unit coupled to a supply voltage. In this case, the control unit is configured to activate the starter with the aid of the switch in the case of failure of the at least one activation line and/or at least one part of the driver unit.

Furthermore, a start-stop system for a motor vehicle is proposed which has a device similar to the one just described.

Furthermore, a motor vehicle is proposed which has such a start-stop system. In the sense of the present application, a motor vehicle is a passenger car, a truck, or a commercial vehicle.

The subclaims provide advantageous refinements and embodiments of the method specified herein and of the device specified herein.

According to one refinement, the switch is closed by the control unit in the case of failure of the at least one activation line and/or at least one part of the driver unit so that the starter is activated by a current flowing from the supply unit via the closed switch.

According to another refinement, the switch is closed synchronously to an activation of the driver unit via the at least one activation line.

The control unit may be configured to close the switch synchronously to a transmission of an activation signal for the driver unit via the at least one activation line.

As already explained previously, the supply unit is configured as a terminal 70 of the motor vehicle, for example. Consequently, the current flowing from the supply unit via the closed switch may also be referred to as terminal 70 current. Terminal 70 current may be used for the driver unit as an activation signal or an enable signal, since the switch is closed by the control unit synchronously to an activation of the driver unit, and a query of terminal 70 current takes place in one logic part of the driver unit. Consequently, the safety of the overall system is advantageously increased, since in this case terminal 30 current may be used for the start or also for the meshing during coasting.

According to another refinement, the driver unit has a power module for activating the starter and a logic part for controlling the power module, an activation signal being provided for activating the power module as a function of a current flowing from the supply unit via the closed switch.

According to another refinement, the current flowing between the supply unit and the driver unit is monitored by the logic part for detecting a start intention of the internal combustion engine, and the activation signal is provided for activating the power module as a function of the monitored current.

A start intention may advantageously be detected by the driver unit with the aid of a constant query of terminal 70 current in the driver unit, even in a non-activated state, and a start may thus be ensured even in the case of failure of all activation lines between the control unit and the driver unit. Here, it is particularly ensured that the control unit may detect the failure of the activation lines and activates the switch between the battery and the driver unit only in the case of a start request. All functions which are not involved in the key start, in particular the meshing during coasting, may be deactivated, since, in particular, it is no longer possible to differentiate between the different actions. Overall, every terminal 70 energization is interpreted as a start request. Advantageously, a start intention may also be detected in this way when the driver unit is not able to receive control signals from the control unit via the activation lines.

The logic part of the driver unit is thus advantageously able to activate the power module with the aid of the provided activation signal. Consequently, the logic part of the driver unit does not solely depend on the control signal transmitted via the at least one activation line.

According to another refinement, the starter is equipped with a starter motor for meshing a starter pinion, with a meshing relay for advancing the starter pinion of the starter, with a starting current relay for providing a starting current for the starter motor and with a main current relay for providing a main current for the starter motor.

According to another refinement, a switching arrangement of the driver unit is controlled as a function of a current flowing between the supply unit and the driver unit in such a way that a first power module for controlling the meshing relay and a second power module for controlling the starting current relay and the main current relay are activated with the aid of the control unit and the switch in the case of failure of the at least one activation line and at least one part of the driver unit.

According to another refinement, the starter is equipped with a starter motor for meshing a starter pinion, with a meshing relay for advancing the starter pinion of the starter, with a resistance switching relay, and with a main switch relay, which is switched in series to the resistance switching relay, for providing a main current for the starter motor.

According to another refinement, a switching arrangement of the driver unit is controlled as a function of a current flowing between the supply unit and the driver unit in such a way that a first power module for controlling the meshing relay and a second power module for controlling the resistance switching relay and the main switch relay are activated with the aid of the control unit and the switch in the case of failure of the at least one activation line and at least one part of the driver unit.

According to another refinement, a delay element is situated between the switching arrangement and the second power module to ensure a reliable start.

The switching arrangement is, for example, configured as a logical break contact which is situated in the driver unit and opened by the functioning logic part of the driver unit during normal operation. If all activation lines between the control unit and the driver unit and/or the logic part itself fail(s), the logical break contact is closed in a non-activated state. An activation of the power module of the driver unit may then be brought about directly by the control unit via the safety switch.

After the logical break contact has been closed, the current flowing via the closed safety switch, in particular the battery current, may be used as the control current for the power module of the driver unit. All output stages may be used for the energization to be able to ensure a start even in the case of a partial failure of the output stages and/or in the case of a partial failure of the starter relay. The delay element, which is, for example, configured as an electrical RC element, is used for activating the output stages for the energization of the starter to be able to advantageously ensure the reliable start. Here, it is advantageously provided that the control unit detects the failure and closes the safety switch only in the case of a start request. All functions which are not involved in the key start, in particular the meshing during coasting, are immediately also deactivated in this case, since it is no longer possible to differentiate between the different actions. Overall, terminal 70 current is necessarily interpreted here as an activation of the starter in the sense of a start action.

According to another refinement, a switching arrangement of the driver unit is controlled as a function of a current flowing between the supply unit and the driver unit in such a way that the meshing relay, the starting current relay, and/or the main current relay are activated with the aid of the control unit and the switch in the case of failure of the at least one activation line and at least one part of the driver unit.

According to another refinement, a switching arrangement of the driver unit is controlled as a function of a current flowing between the supply unit and the driver unit in such a way that the meshing relay and the main current relay and, optionally, the resistance switching relay are activated with the aid of the control unit and the switch in the case of failure of the at least one activation line and at least one part of the driver unit.

According to another refinement, the delay element is situated between the switching arrangement and the starting current relay, and/or between the switching arrangement and the main current relay to ensure a reliable start.

According to another refinement, a delay element is situated between the switching arrangement and the resistance switching relay, and between the switching arrangement and the main switch relay to ensure a reliable start.

Here, too, the switching arrangement may be configured as a logical break contact in the driver unit. The logical break contact is operated in the open state by the functioning logic part in the driver unit during normal operation. If all activation lines and/or the logic part of the driver unit fail(s), the logical break contact is closed in a non-activated state. An activation of the starter relay may now be carried out directly by the control unit via the provided safety switch. In a parallel configuration for starter energization, the starting current relay and the main current relay may be used to be able to ensure a start even in the case of failure of one of these relays. In a configuration in series, the main switch relay must switch to energize the starter. For this purpose, both windings may be energized to still be able to switch the particular relay even in the case of failure of a hold-in winding and thus to be able to ensure the start. The delay element, which may be configured as a relay, is used for activating the relays for the energization of the starter to be able to ensure a reliable start. Furthermore, it is advantageously provided that the control unit may detect the failure and closes the safety switch only in the case of a start request. Furthermore, all functions which are not involved in the key start, in particular for the meshing during coasting, are deactivated, since it is no longer possible to differentiate between the different actions. In this case, every terminal 70 energization is necessarily followed by an activation of the starter in the sense of a start action. One advantage of this refinement is in particular that the delay relay only has to switch the activating current for the main current, but not the main current itself. Consequently, the design requirements are minor.

According to another refinement, a switching arrangement of the driver unit is controlled as a function of a current flowing between the supply unit and the driver unit in such a way that the meshing relay and the starter motor are activated with the aid of the control unit and the switch in the case of failure of the at least one activation line and at least one part of the driver unit.

According to another refinement, a delay element is situated between the switching arrangement and the starter motor to ensure a reliable start.

Here, too, the switching arrangement may be configured as a logical break contact in the driver unit, this break contact being opened by the functioning logic part in the driver unit during normal operation. If, however, all activation lines between the control unit and the driver unit and/or the logic part of the driver unit itself fail(s), the logical break contact is closed in a non-activated state. An activation of the starter motor and its meshing relay may now be carried out directly by the control unit via the safety switch.

Only the starter motor itself and its meshing relay may be energized in this case. However, both windings of the meshing relay may be energized to switch the relay even in the case of failure of the hold-in winding of the meshing relay and thus to still enable the start. The delay element, which may be configured as an electrical relay, is used for activating the main current to ensure a reliable start. Moreover, it is advantageously ensured that the control unit may detect a failure and closes the safety switch only in the case of a start request. All functions which are not involved in the key start, in particular a meshing during coasting, are immediately deactivated, since it is no longer possible to differentiate between the different actions. Every terminal 70 energization is followed by an activation of the starter in the sense of a start action.

According to another refinement, the switching arrangement is activated by the logic part of the driver unit in such a way that the switching arrangement is open in an activated state and closed in a non-activated state.

Other exemplary embodiments of the present invention are illustrated in the drawings and explained in greater detail in the description that follows.

DETAILED DESCRIPTION

Figure 1:
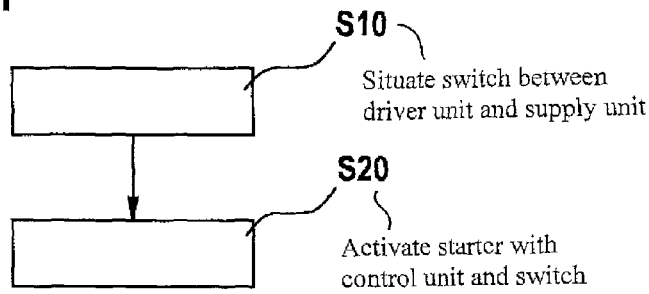
FIG. 1 shows a schematic flow chart of an exemplary embodiment of a method for activating a starter, which is controllable by a driver unit.

FIG. 1 shows a schematic flow chart of an exemplary embodiment of a method for activating a starter, which is controllable by a driver unit.

Figure 2:
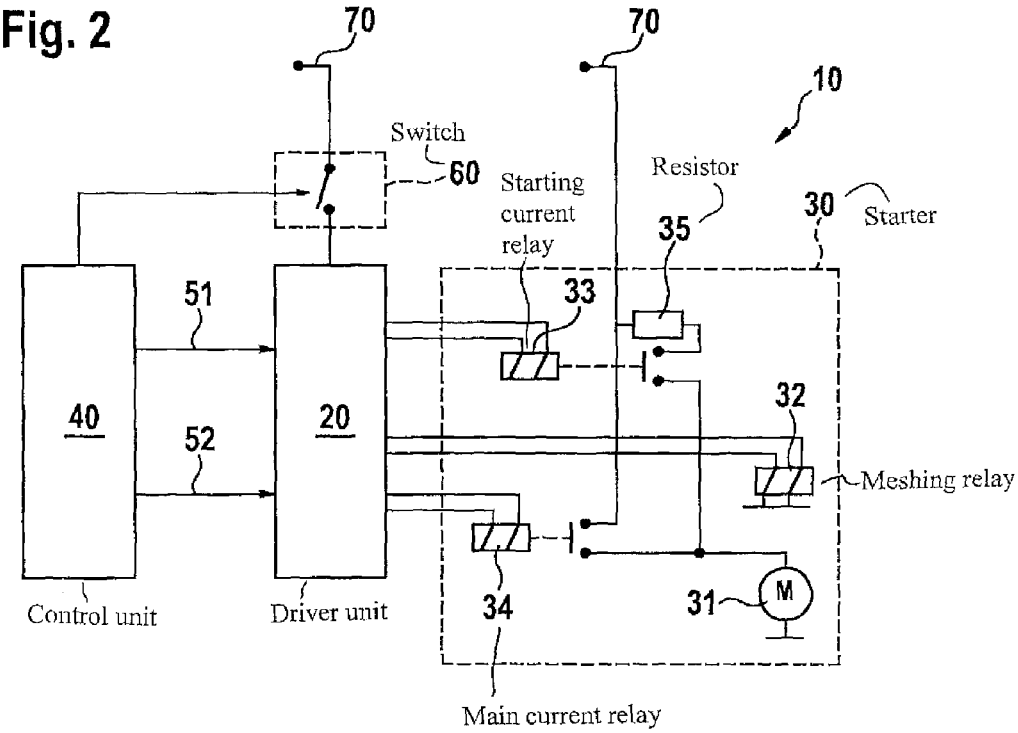
FIG. 2 shows a schematic view of a first exemplary embodiment of a device for activating a starter, which is controllable by a driver unit.

The method of FIG. 1 is explained in greater detail with reference to FIG. 2. FIG. 2 shows a device 10 for activating a starter 30, which is controllable by a driver unit 20.

One advantage is that in every non-activated state, the switch or the safety switch is closed and consequently an activation is made possible for the control unit with the aid of the battery current.

The diagnosis of the driver unit takes place, in particular, out of the control unit via the activation lines between the control unit and the driver unit. This at least one activation line includes, for example, a bidirectional LIN interface and a hardwired interface having a pulse-width modulated signal. The latter is, in particular, configured as a unidirectional interface between the control unit and the driver unit. In this case, the control unit cannot differentiate between a failure of the interfaces and a failure or partial failure of the driver unit. Advantageously, this is also not important for the functionality of the present invention. The diagnosis of the LIN interface takes place by an observation of the signals received by the driver unit. If signals are no longer received, this LIN interface is inactive or defective.

The diagnosis of the unidirectional interface which transmits control signals from the control unit to the driver unit is implemented on the side of the control unit through a diagnosis of the output stages. In the case of failure in the driver unit, the voltage level at the unidirectional interface may be changed by a logical break contact in the receiving device of the driver unit in such a way that a failure is reliably detectable by the control unit. This is implemented in particular by an observation of the voltage at the unidirectional interfaces within the control unit.

Device 10 furthermore has a control unit 40 which is coupled to driver unit 20 with the aid of two activation lines 51 and 52. A first activation line 51 is, for example, configured as a unidirectional interface. Furthermore, a second activation line 52 may be configured as a bidirectional interface, e.g., as a LIN interface.

Furthermore, device 10 has a switch 60 which is controllable by control unit 40 and is situated between driver unit 20 and a supply unit 70 coupled to the supply voltage. Supply unit 70 is, for example, terminal 70 of the motor vehicle.

Starter 30, in particular, has a starter motor 31 for meshing a starter pinion, a meshing relay 32 for advancing the starter pinion of starter 30, a starting current relay 33 for providing a starting current for starter motor 31, and a main current relay 34 for providing a main current for starter motor 30. A series resistor 35 is connected upstream from starting current relay 33.

In step S10, switch 60 is situated between driver unit 20 and supply unit 70.

In step S20, starter 30 is activated with the aid of control unit 40 and switch 60 in the case of failure of activation lines 51, 52 and/or in the case of failure of at least one part of driver unit 20.

Switch 60 is closed by control unit 40, in particular, in the case of failure of activation lines 51, 52 and/or in the case of failure of at least one part of driver unit 20 so that starter 30 may be activated by a current flowing from supply unit 70 via closed switch 60. In particular, switch 60 is closed here by control unit 40 synchronously to an activation of driver unit 20 via at least one activation line 51, 52. Control unit 40 is, in particular, configured in this case to close switch 60 synchronously to a transmission of an activation signal for driver unit 20 via activation lines 51, 52.

Figure 3:
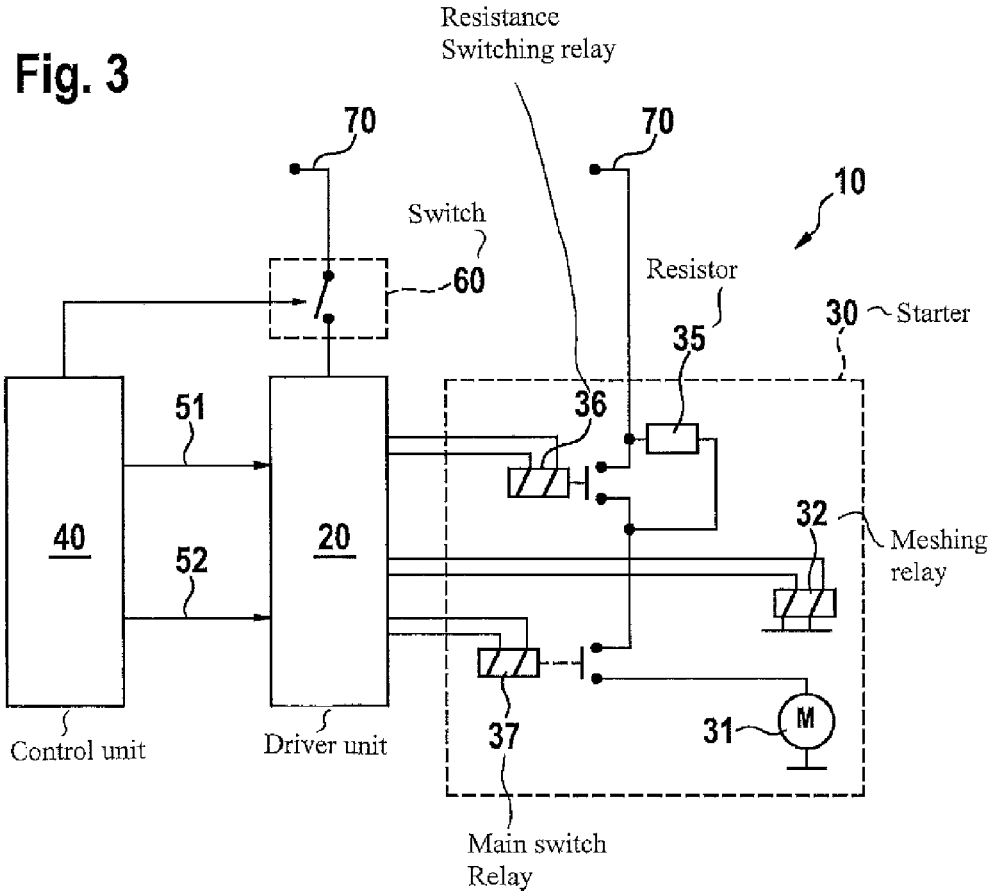
FIG. 3 shows a schematic view of a variant of the first exemplary embodiment of the device for activating a starter according to FIG. 2, which is controllable by a driver unit.

FIG. 3 illustrates a schematic view of a variant of the first exemplary embodiment of device 10 of FIG. 2. Starter 30 of FIG. 3 here has a starter motor 31 for meshing a starter pinion, a meshing relay 32 for advancing the starter pinion of starter 30, a resistance switching relay 36 and a main switch relay 37, which is switched in series to resistance switching relay 36, for providing a main current for starter motor 31.

The other exemplary embodiments of device 10 of FIGS. 3 through 6 are based on the exemplary embodiment of device 10 according to FIG. 2, so that matching properties are not explained again in detail.

Figure 4:
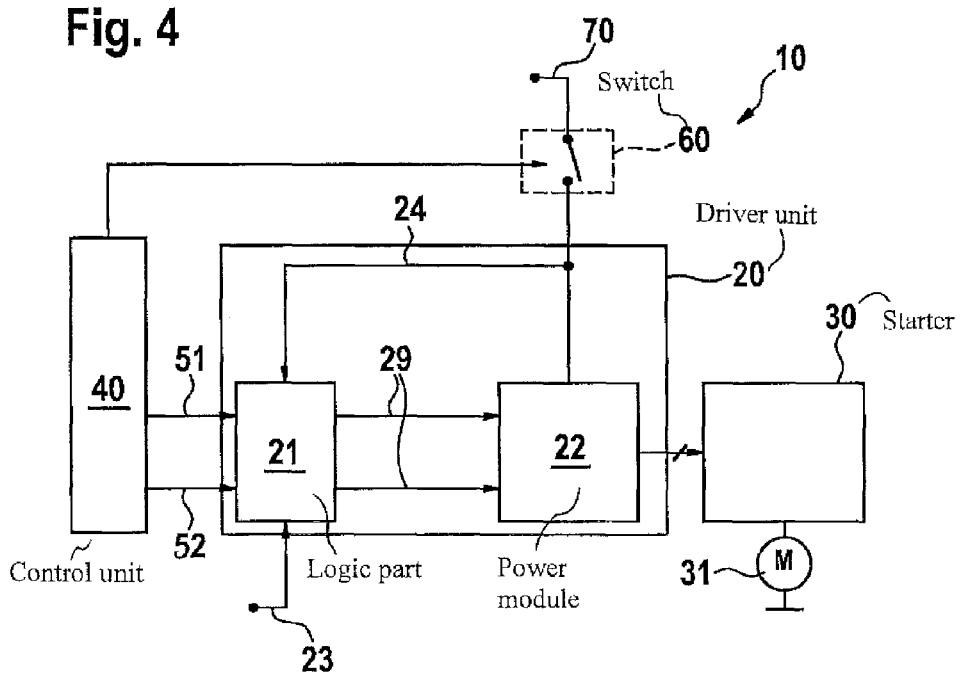
FIG. 4 shows a schematic view of a second exemplary embodiment of a device for activating a starter, which is controllable by a driver unit.

According to the exemplary embodiment of FIG. 4, driver unit 20 has a power module 22 for activating starter 30 and a logic part 21 for controlling power module 22. Logic part 21 is coupled to terminal 87 of the motor vehicle, which is denoted with reference numeral 23. The current flowing between supply unit 70 and driver unit 20 is monitored by logic part 21 for detecting a start intention of the internal combustion engine. A line 24 is provided for this monitoring. As a function of the monitoring of the current flowing between supply unit 70 and driver unit 20, at least one activation signal is generated and provided to power module 22 via lines 29.

Figure 5:
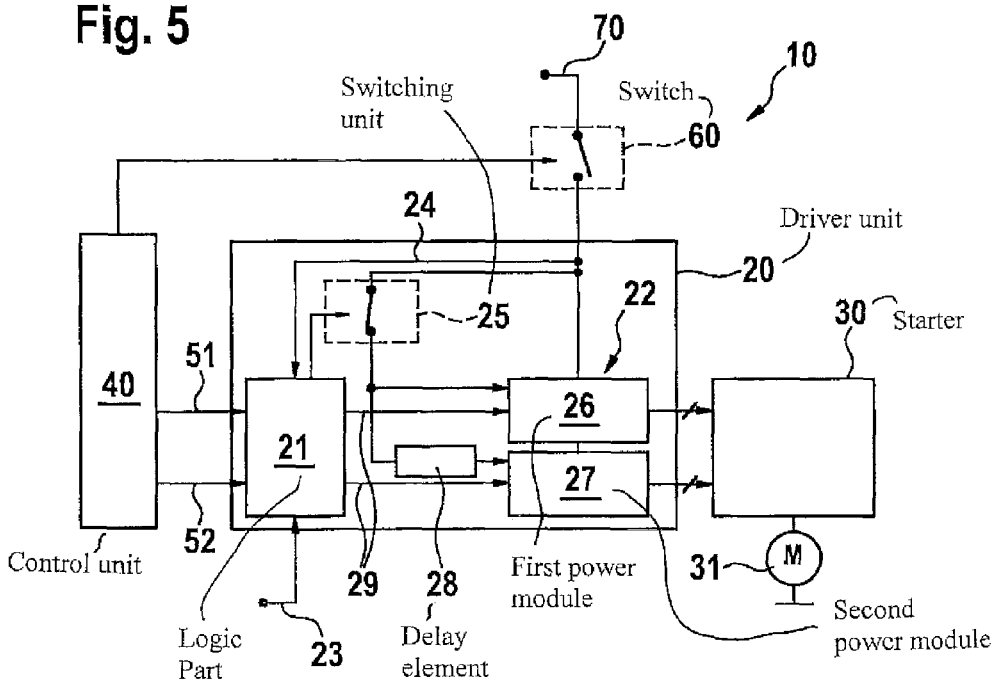
FIG. 5 shows a schematic view of a third exemplary embodiment of a device for activating a starter, which is controllable by a driver unit.

In the exemplary embodiment of device 10 according to FIG. 5, a switching arrangement 25 is provided in driver unit 20. Switching arrangement 25 is switched between switch 60 and power module 22 of driver unit 20. Here, switching arrangement 25 of driver unit 20 is controlled as a function of the current flowing between supply unit 70 and driver unit 20 in such a way that a first power module 26 for controlling meshing relay 32 and a second power module 27 for controlling starting current relay 33 and main current relay 34 are activated with the aid of control unit 40 and switch 60 in the case of failure of activation lines 51 and 52 and logic part 21 of driver unit 20.

Furthermore, driver unit 20 of FIG. 5 has a delay element 28. Delay element 28 is situated between switching arrangement 25 and second power module 27 and is configured to ensure a reliable start.

Figure 6:
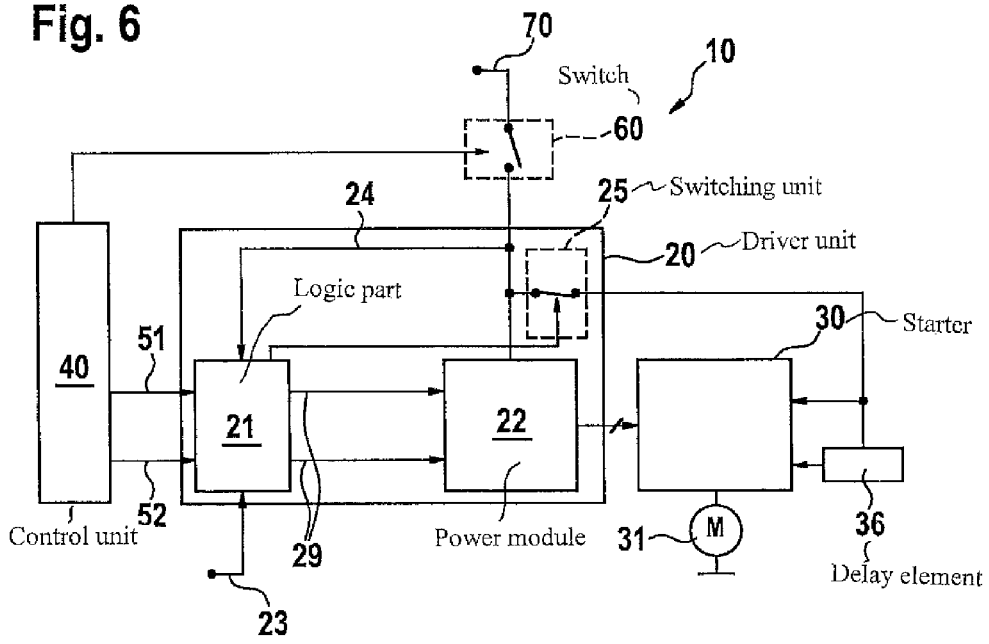
FIG. 6 shows a schematic view of a fourth exemplary embodiment of a device for activating a starter, which is controllable by a driver unit.

According to the exemplary embodiment of device 10 of FIG. 6, a switching arrangement 25 is situated between switch 60 and starter 30. Device 10 of FIG. 6 makes it possible to bypass entire driver unit 20 in the case of failure and to activate starter 30 with the aid of control unit 40, switch 60, and switching arrangement 25.

Here, switching arrangement 25 of driver unit 20 is controlled as a function of a current flowing between supply unit 70 and driver unit 20 in such a way that meshing relay 32, starting current relay 33, and/or main current relay 34 are activated with the aid of control unit 40 and switch 60 in the case of failure of activation lines 51 and 52 and of driver unit 20.

Furthermore, device 10 of FIG. 6 has a delay element 36 which ensures a reliable start and is situated between switching arrangement 25 and starting current relay 33 or main current relay 34.

Figure 7:
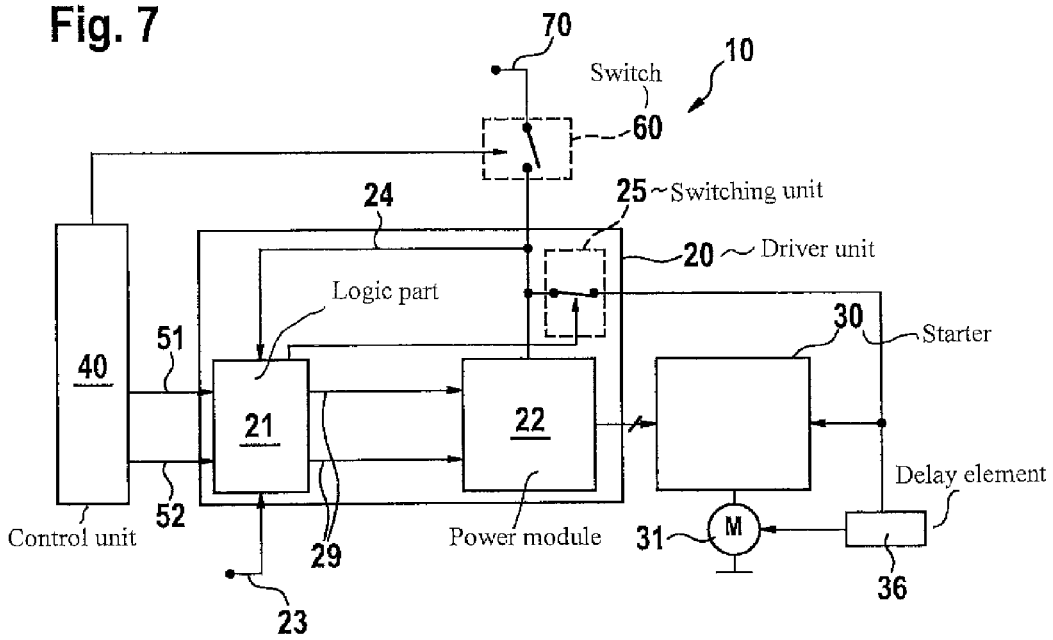
FIG. 7 shows a schematic view of a fifth exemplary embodiment of a device for activating a starter, which is controllable by a driver unit.

Another exemplary embodiment of device 10 is illustrated in FIG. 7. Device 10 of FIG. 7 makes it possible to bypass entire driver unit 20 as well as the activation relays for the energization of starter motor 31. For this purpose, a switching arrangement 25 is provided in driver unit 20 according to FIG. 7. Switching arrangement 25 in driver unit 20 of FIG. 7 is controlled as a function of the current flowing between supply unit 70 and driver unit 20 in such a way that meshing relay 32 and starter motor 31 are activated with the aid of control unit 40 and switch 60 in the case of failure of activation lines 51, 52 and of driver unit 20. Device 10 of FIG. 7 furthermore has a delay element 36 which is situated between switching arrangement 25 and starter motor 31 and is configured to ensure a reliable start.

What is claimed is:

1. A device for activating a starter, which is controllable by a driver unit, for an internal combustion engine of a motor vehicle, the driver unit being controllable by a control unit with the aid of at least one activation line, comprising:

a switch which is controllable by the control unit and which is situated between the driver unit and a supply unit coupled to a supply voltage, the control unit being configured to activate the starter with the aid of the switch in the case of failure of at least one of the at least one activation line and at least one part of the driver unit, wherein the switch is closed by the control unit in the case of failure of at least one of the at least one activation line and the at least one part of the driver unit so that the starter is activated by a current flowing from the supply unit via the closed switch.

2. A start-stop system for a motor vehicle, comprising:

a device for activating a starter, which is controllable by a driver unit, for an internal combustion engine of a motor vehicle, the driver unit being controllable by a control unit with the aid of at least one activation line, including:

a switch which is controllable by the control unit and which is situated between the driver unit and a supply unit coupled to a supply voltage, the control unit being configured to activate the starter with the aid of the switch in the case of failure of at least one of the at least one activation line and/or at least one part of the driver unit, wherein the switch is closed by the control unit in the case of failure of at least one of the at least one activation line and the at least one part of the driver unit so that the starter is activated by a current flowing from the supply unit via the closed switch.

3. A method for activating a starter for an internal combustion engine of a motor vehicle, the method comprising:

activating a starter with the aid of a control unit and a switch in the case of failure of at least one of at least one activation line and at least one part of a driver unit, wherein the starter is controllable by the driver unit, which is controllable by the control unit with the aid of the at least one activation line, and wherein the switch, which is controllable by the control unit, is situated between the driver unit and a supply unit coupled to a supply voltage, wherein the switch is closed by the control unit in the case of failure of at least one of the at least one activation line and the at least one part of the driver unit so that the starter is activated by a current flowing from the supply unit via the closed switch.

4. The method of claim 3, wherein the switch is closed synchronously to an activation of the driver unit via the at least one activation line.

5. The method of claim 3, wherein the driver unit has a power module for activating the starter and a logic part for controlling the power module, an activation signal being provided for activating the power module as a function of a current flowing from the supply unit via the closed switch.

6. The method of claim 5, wherein the current flowing between the supply unit and the driver unit is monitored by the logic part for detecting a start intention of the internal combustion engine and the activation signal is provided for activating the power module as a function of the monitored current.

7. The method of claim 3, wherein the starter is equipped with a starter motor for meshing a starter pinion, with a meshing relay for advancing the starter pinion of the starter, with a starting current relay for providing a starting current for the starter motor and with a main current relay for providing a main current for the starter motor.

8. The method of claim 7, wherein a switching arrangement of the driver unit is controlled as a function of a current flowing between the supply unit and the driver unit so that a first power module for controlling the meshing relay and a second power module for controlling the starting current relay and the main current relay are activated with the aid of the control unit and the switch in the case of failure of the at least one activation line and at least one part of the driver unit.

9. The method of claim 8, wherein a delay element is situated between the switching arrangement and the second power module to ensure a reliable start.

10. The method of claim 7, wherein a switching arrangement of the driver unit is controlled as a function of a current flowing between the supply unit and the driver unit so that the meshing relay, the starting current relay, and/or the main current relay are activated with the aid of the control unit and the switch in the case of failure of the at least one activation line and at least one part of the driver unit.

11. The method of claim 10, wherein a delay element is situated between the switching arrangement and the starting current relay, and/or between the switching arrangement and the main current relay to ensure a reliable start.

12. The method of claim 7, wherein a switching arrangement of the driver unit is controlled as a function of a current flowing between the supply unit and the driver unit so that the meshing relay and the starter motor are activated with the aid of the control unit and the switch in the case of failure of the at least one activation line and at least one part of the driver unit.

13. The method of claim 12, wherein a delay element is situated between the switching arrangement and the starter motor to ensure a reliable start.

14. The method of claim 8, wherein the switching arrangement is activated by the logic part of the driver unit so that the switching arrangement is open in an activated state and closed in a non-activated state.

* * * * *